US006142620A

United States Patent [19]

Sagi

[11] Patent Number: 6,142,620

[45] Date of Patent: Nov. 7, 2000

[54] METHOD AND APPARATUS FOR PRINTING SIGNS AND SIGNS CONSTRUCTED IN ACCORDANCE WITH SAID METHOD AND/OR BY SAID APPARATUS

[75] Inventor: Aviezer I. Sagi, Petach Tikva, Israel

[73] Assignee: Nur Macroprinters, Ltd., Moshay Magshimim, Israel

[21] Appl. No.: 09/085,191

[22] Filed: May 27, 1998

[30] Foreign Application Priority Data

May 27, 1997 [IL] Israel ..... 120926

[51] Int. Cl.[7] ..... B41J 2/01

[52] U.S. Cl. ..... 347/101; 40/564; 40/615; 347/105

[58] Field of Search ..... 347/101, 104, 347/105, 106, 107; 40/615, 564, 575; 283/94; 427/466, 258

[56] References Cited

U.S. PATENT DOCUMENTS

| | | | |
|---|---|---|---|
| 2,143,141 | 1/1939 | Cooley | 428/66.5 |
| 3,680,238 | 8/1972 | Arnold | 40/132 R |
| 4,500,374 | 2/1985 | Nakazima | 156/83 |
| 4,933,212 | 6/1990 | Gerstner et al. | 427/258 |
| 5,106,126 | 4/1992 | Longobardi et al. | 283/94 |
| 5,144,328 | 9/1992 | Blake et al. | 347/101 |
| 5,223,357 | 6/1993 | Lovison | 430/1 |
| 5,294,946 | 3/1994 | Gandy et al. | 346/140 R |
| 5,376,957 | 12/1994 | Gandy et al. | 347/3 |
| 5,756,153 | 5/1998 | Plourde | 427/207.1 |
| 5,800,909 | 9/1998 | Nitta et al. | 428/207 |

FOREIGN PATENT DOCUMENTS

| | | |
|---|---|---|
| 0 458 631 A2 | 11/1991 | European Pat. Off. . |
| 1-198354 | 8/1989 | Japan . |
| 8-185125 | 7/1996 | Japan . |
| 9-30100 | 2/1997 | Japan . |
| WO 97/44195 | 11/1997 | WIPO . |

*Primary Examiner*—Joan Pendergrass
*Attorney, Agent, or Firm*—David J. Weitz; Wilson Sonsini Goodrich & Rosati

[57] ABSTRACT

A method for printing signs by printing a first ink layer directly on one face of a transparent substrate; applying an intermediate layer over the first ink layer; and printing a second ink layer directly on the intermediate layer.

27 Claims, 3 Drawing Sheets

FIG. 3
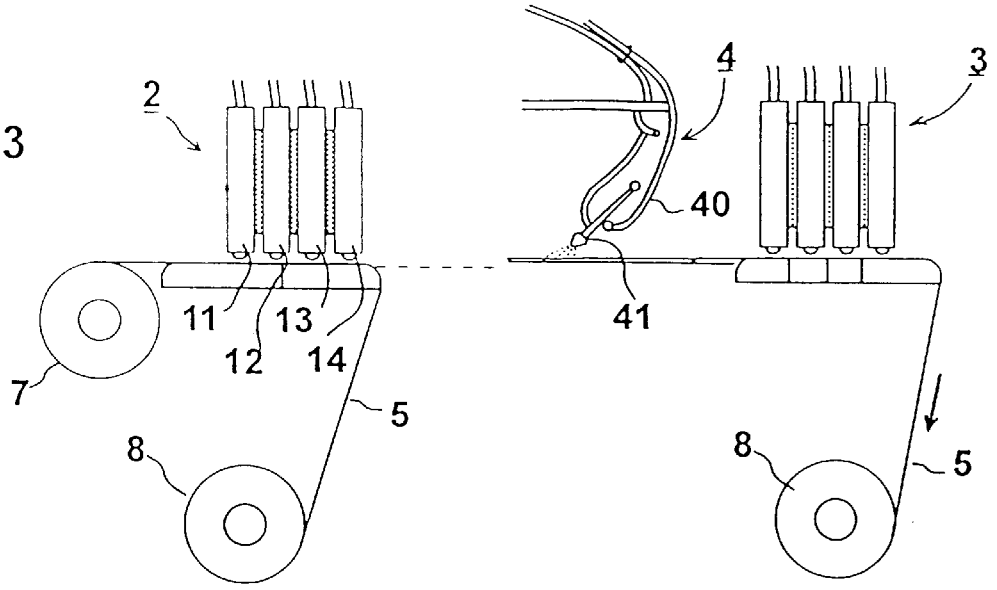
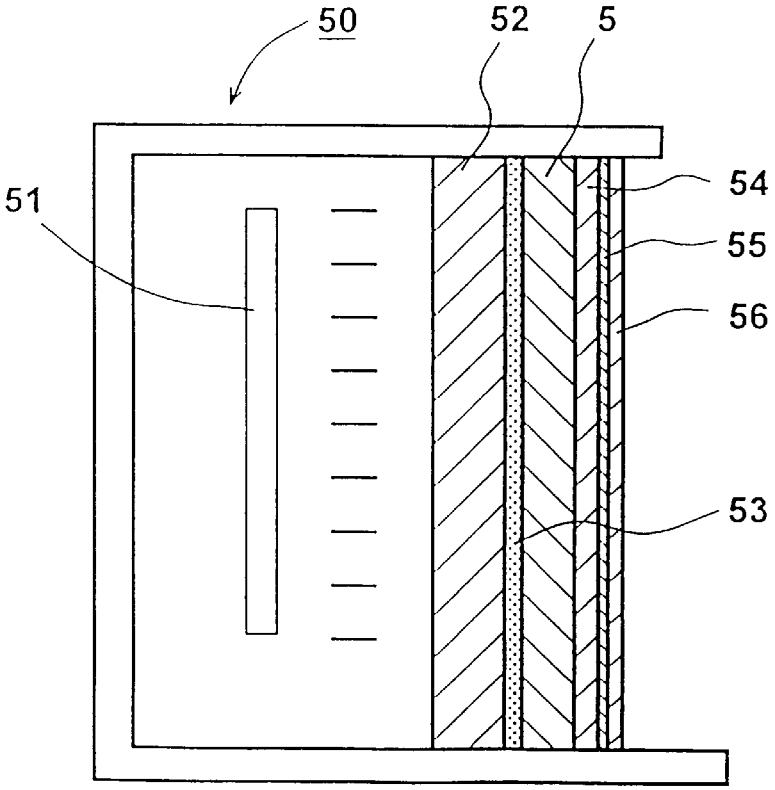
FIG. 4

METHOD AND APPARATUS FOR PRINTING SIGNS AND SIGNS CONSTRUCTED IN ACCORDANCE WITH SAID METHOD AND/OR BY SAID APPARATUS

FIELD AND BACKGROUND OF THE INVENTION

The present invention relates to methods and apparatus for printing signs, and also to a sign constructed in accordance with such method and/or such apparatus. The invention is particularly useful with respect to the production of multi-color signs which are front-illuminated in the daytime (e.g., by natural daylight) and back-illuminated at nighttime, such as used in billboards and the like, and is therefore described below particularly with respect to such an application. As will be described below, the invention could also be used in signs which are not back-illuminated, but which display the same or different pictures from its opposite sides.

Large signs used in billboards, particularly of the multi-color type, frequently include artificial back lighting at the inner face to enhance the image viewed from the outer face of the sign. However, such artificial back lighting tends to "wash out" the colors of the sign, that is, to make the colors appear much lighter than they really are because of the added artificial illumination. One method of minimizing such "wash out" effects, as described for example in U.S. Pat. No. 5,294,946, is to print the same image on both sides of the substrate, such that the double-sided image is provided with enough color density to decrease the tendency of the back lighting to wash out the colors. However, printing the image on both sides of the substrate limits the possible applications for such signs. For example, signs of this type are frequently pre-coated with an adhesive layer on one face of the substrate, covered by a protective layer which is removed, for adhesively fixing the sign to a mounting panel. However, where an image is printed on both faces of the substrate, one face would not be available for receiving the adhesive coating.

Nakazima U.S. Pat. No. 4,500,374 discloses a technique for producing illuminated signs including two printed layers separated by a semi-opaque layer. In the technique described therein, each ink layer is a printed layer of water-resistant ink printed on a pulp board sheet which sheets are bonded together and subsequently dissolved to leave only the printed layers. Such a technique is a gluing technique, and not an actual printing technique. Moreover, it requires special inks and substrates which would not dissolve with the pulp board sheets. In addition, such a technique does not permit volume low-cost production of signs of this type.

OBJECTS AND BRIEF SUMMARY OF THE INVENTION

An object of the present invention is to provide a method for printing signs having advantages in the above respects. Other objects of the invention are to provide apparatus for use in printing signs, and also printed signs constructed in accordance with such method.

According to one aspect of the present invention, there is provided a method of printing signs, comprising: printing a first ink layer directly on one face of a transparent substrate; applying an intermediate layer over the first ink layer; and printing a second ink layer directly on the intermediate layer.

According to further features in the described preferred embodiments of the invention, the first and second ink layers are each printed by an ink jet printer. In addition, the intermediate layer is air sprayed as a coating onto the first ink layer. Preferably, the face of the transparent sheet opposite to the face carrying the layers of liquid ink is pre-coated with an adhesive material covered by a removable protective layer which, after the printing of the first and second ink layers with the intermediate coating in between, is removed from the substrate to expose the adhesive material for adhesively attaching the sign to a supporting member.

In one described embodiment of the invention, the two ink layers, and the intermediate layer between them, may be applied serially in one pass of the substrate through a liquid ink printing station and a coating station. In other described embodiments, the first and second ink layers may be applied in two passes of the substrate through the liquid ink printing station, with the intermediate layer applied either at the end of the first pass or at the beginning of the second pass.

The invention is particularly useful in back-illuminated signs, whereupon the intermediate layer would be of a white semi-opaque material, and the first and second ink layers would be the same printed pictures. However, the invention is also applicable for signs which are not back-illuminated, but which display different pictures from its opposite sides whereupon the intermediate layer would be of an opaque material, and the first and second ink layers would be different or the same printed pictures.

According to another aspect of the invention, there is provided apparatus for printing signs, comprising: an ink printing station including a plurality of nozzles for printing a liquid ink layer directly on one face of a substrate; a coating station for applying an intermediate coating onto the ink layer; and a substrate drive for driving the substrate first through the ink printing station and then through the coating station.

According to a still further aspect of the invention, there is provided a printed sign comprising: a transparent substrate; an adhesive coating on a first face of the transparent substrate; a removable protective layer covering the adhesive coating; a first printed ink layer on the opposite face of the transparent substrate; an intermediate coating of a white semi-opaque material on the first printed ink layer; and a second printed ink layer on the coating of white semi-opaque material.

As will be described more particularly below, the foregoing method and apparatus permit multi-color signs to be made, particularly for use with artificial back lighting, without producing the "wash out" effect of previous constructions of back lit signs, and without precluding the use of substrates pre-coated with an adhesive, covered by a removable protective layer, for adhesively fixing the sign to a mounting member. The invention also permits such signs to be constructed with a wide variety of substrates and liquid ink materials, and in a substantially continuous manner enabling volume low-cost production.

As will also be described below, while the invention is particularly useful for back-illuminated signs, it may be also used for producing conventional signs for displaying two different pictures from its opposite sides.

Further features and advantages of the invention will be apparent from the description below.

BRIEF DESCRIPTION OF THE DRAWINGS

The invention is herein described, by way of example only, with reference to the accompanying drawings, wherein:

FIGS. 2 and 3 illustrate two alternative constructions of the apparatus for producing the multi-color signs produced by the apparatus of FIG. 1;

FIG. 4 is a sectional view diagramatically illustrating one construction of a back-illuminated sign made in accordance with the apparatus of FIGS. 1–3.

DESCRIPTION OF PREFERRED EMBODIMENTS

Figure 1:
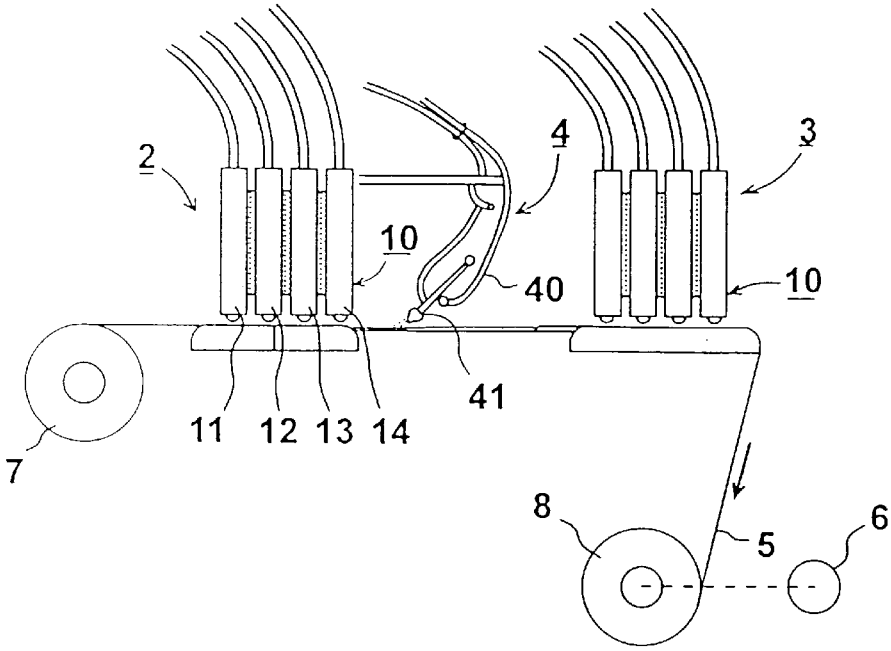
FIG. 1 schematically illustrates one form of apparatus constructed in accordance with the present invention for producing multi-color signs.

The apparatus illustrated in FIG. 1 includes two ink printing stations 2, 3, arranged in tandem, with an air-brush spraying station 4 in between, for printing on one side of a substrate 5 as it is driven by a drive 6 from a supply reel 7 to a take-up reel 8. Substrate 5 is of a transparent plastic material, preferably a flexible plastic sheet material. A multi-color image is printed with liquid ink on one face of the substrate at printing station 2; that image is then covered by a coating of a white semi-opaque or translucent material applied at the air-brush spraying station 4; and then a second multi-color image is printed with liquid ink over the air-brush coating at printing station 3.

As will be described more particularly below with reference to FIG. 4, the printed substrate produced by the apparatus illustrated in FIG. 1 is particularly useful in back-illuminated outdoor signs, wherein the printed substrate is adhesively attached to a transparent mounting member in the sign. Therefore, only one face of the substrate is printed with the two images and with the white semi-opaque coating in between, which leaves the opposite face of the substrate available for the adhesive coating if such a coating is desired. Preferably, the substrate 5 is pre-coated with the adhesive and covered by a removable protective layer before the ink layers are printed on the non-adhesive face of the substrate, such that after the ink layers are printed, the protective layer is removed from the adhesive coating thereby exposing the adhesive for attaching the sign to a mounting member.

Each of the printing stations 2, 3 is occupied by a printing system, generally designated 10. As shown in FIG. 1, the same printing system 10 may be used for both printing stations 2, 3. Preferably, each printing system 10 includes an ink-jet printing head assembly for continuously printing a multi-color image. An example of an ink-jet printing system 10 which may be used, particularly for water-based (slow drying) inks, is that described in co-pending operation Ser. No. 08/627,437, filed Apr. 4, 1996, assigned to the same assignee as the present application, and hereby incorporated by reference. Such a printing system includes four monochrome printing heads for printing the four process colors cyan (C), magenta (M), yellow (Y) and black (K) with water based inks, which are quickly dried after each process color is printed and before the application of the next process color. However, if quick-drying solvent-based inks are used, e.g., based on MEK (methyl ethyl ketone), a drier is not necessary.

Figure 2:
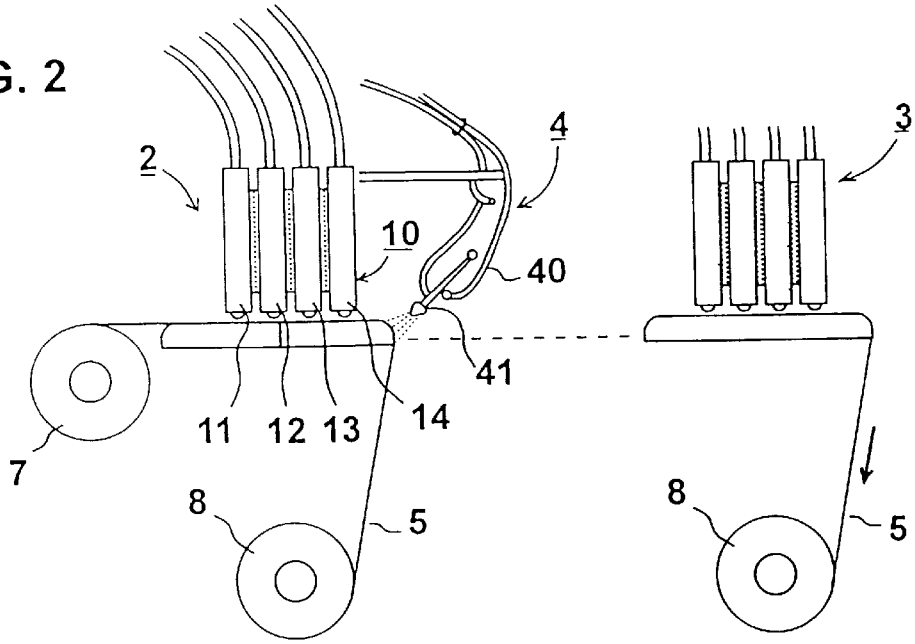

FIG. 1 illustrates a single-pass arrangement wherein the printed ink layers, and the air-brush coating in between, are all applied in a single pass of the substrate 5. FIGS. 2 and 3 illustrate two-pass arrangements, wherein each of the two printed layer is applied in a separate pass of the substrate 5. Thus, in the FIG. 2 arrangement, the first printed layer (of station 2) and the air-brush coating (of station 4) are applied in one pass, and the second printed layer (of printing station 3) is applied in a second pass. In the FIG. 3 arrangement, the printed layer of station 2 only is applied in the first pass, and the air-brush layer of station 4 and the second printed layer of station 3 are applied in the second pass.

In all three arrangements illustrated in FIGS. 1–3, the printing system 10 may be the same for printing both ink layers. Each printing system 10 includes an assembly of four monochromic printing heads 11, 12, 13, 14, each having a plurality of nozzles for emitting electrically-charged ink drops onto the substrate 5 as relative movement is effected between the print heads and the substrate. Thus, the print head assembly 10 is continuously moved transversely across the substrate 5, first in one direction and then in the opposite direction. During each reversal of movement of the print head assembly 10, the substrate 5 is stepped, in the longitudinal direction of the substrate, the width of one of the monochrome print heads 11–14, so that all four processor colors are printed in four sequential steps in each transverse section of the substrate. The ink of each process color dries very quickly, before the next one is applied.

After one multi-color layer is printed in printing station 2 and dried, an air-brush coating is applied in station 4 over this printed layer. For this purpose, the air-brush, schematically shown at 40 in FIGS. 1–3, includes a nozzle 41 which sprays a coating of white semi-opaque material onto the first printed layer applied in printing station 2. Such a coating also dries very quickly.

Following the application and drying of the white semi-opaque coating by the air-brush unit 40 in station 4, a second multi-color ink layer is printed on top of the air-brush coating by a second printing assembly 10 in printing station 3 in the same manner as in printing station 2.

FIG. 4 illustrates, for purposes of example, one construction of a back-illuminated sign including the printed substrate produced as described above. The sign illustrated in FIG. 4 includes a housing 50 containing an artificial light source 51 behind a transparent or translucent mounting panel 52. The transparent substrate 5 is adhesively fixed to the transparent (or translucent) panel 52 by the pre-coating of adhesive 53 applied to the non-printed face of the substrate and exposed for fixing by the removal of the protective layer (not shown), such that the printed face of the substrate faces outwardly of housing 50. Thus, the transparent substrate 5 includes a first printed layer 54 applied in printing station 2, a coating 55 of white semi-opaque material applied in the spray-coating station 4, and a second printed layer 56 applied in printing station 3.

Figure 5:
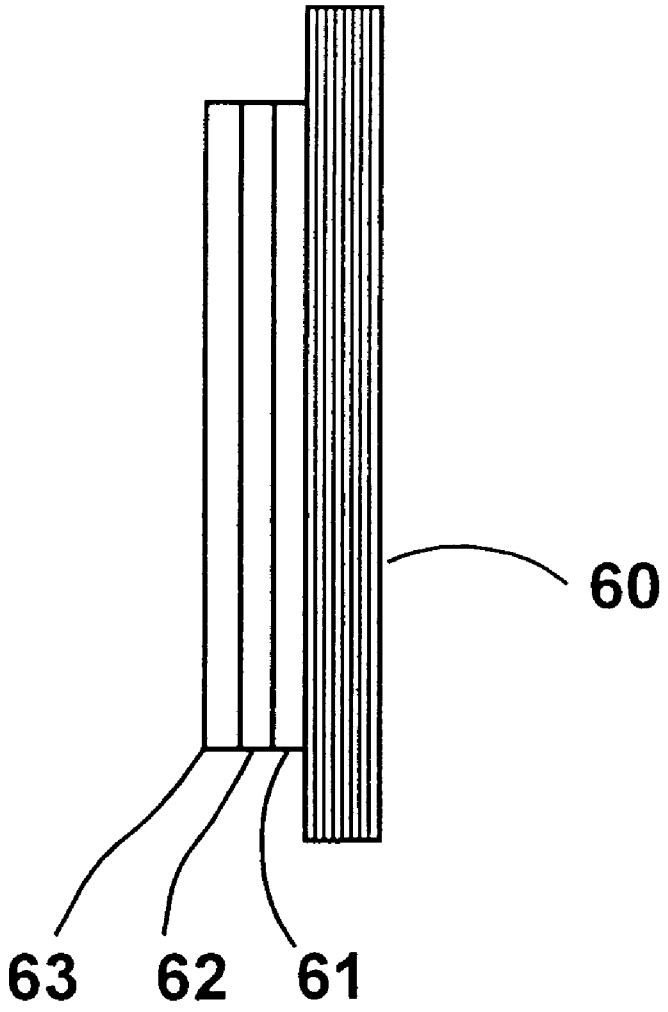
FIG. 5 diagramatically illustrates the invention embodied in a sign which is not back-illuminated, but which displays pictures on its two opposite faces.

FIG. 5 illustrates, for purposes of example, a construction of a sign which is not back-illuminated, but which displays two pictures (the same or different pictures) from its opposite sides. Thus, the sign illustrated in FIG. 5 includes a transparent substrate 60, a first printed ink layer 61 on one face of the transparent substrate, an intermediate coating 62 on the printed ink layer 61, and a second printed ink layer 63 on the coating 62. In this case, the coating 62 is a fully-opaque coating, which is preferably white, to prevent the printed ink layer 61 from being viewed from the side of viewing the printed ink layer 63. Thus, the printed ink layer 61 would be viewed from one side of the sign (right side, FIG. 5), whereas the printed ink layer 63 would be viewed from the opposite side (left side, FIG. 5).

The transparent substrate 60 is preferably a rigid transparent panel capable of serving as a mounting base for the sign. Thus, the sign could be mounted by a panel 60 so as to permit both sides of the sign to be viewed from the opposite side of the sign.

While the invention has been described with respect to several preferred embodiments, it will be appreciated that these are set forth merely for purposes of example, and that many other variations and applications of the invention may be made. For example, the sign could be mounted in other manners, e.g., by ropes, clamps or other forms of attachment, rather than by an adhesive coating. Also, the ink layers could be printed in other manners. Further, the white semi-opaque layer could be applied by coating this layer on a transparent plastic film and gluing this film to the substrate. Many other variations and applications of the invention will be apparent to those skilled in the art.

What is claimed is:

1. A method comprising of printing signs, comprising;

printing a first ink layer directly on one face of a trasparent substrate;

applying an intermediate layer over said first ink layer; and printing a second ink layer directly on said intermediate layer, wherein said first ink layer, said intermediate layer, and said ink layer are applied serially in a single pass of the substrate through a first ink jet printing station, a coating station for the intermediate layer, and a second ink jet printing station.

2. The method according to claim 1, wherein each of said first and second layers is of liquid ink printed by an ink jet printer and is dried before the next layer is applied.

3. The method according to claim 2, wherein said intermediate layer is air sprayed as a coating onto said first ink layer.

4. The method according to claim 1, wherein the face of said transparent substrate opposite to said one face is pre-coated with an adhesive material covered by a removable protective layer which, after the printing of said first and second ink layers with said intermediate layer in between, is removed from the substrate to expose the adhesive material for attaching said sign to a mounting member.

5. The method according to claim 1, wherein said trasparent substrate is of a flexible plastice sheet material.

6. The method according to claim 1, wherein said first ink layer and said intermediate layer are applied serially in one pass of the substrate through an ink jet printing station and a coating station; and said second ink layer is applied to said intermediate layer in a second pass of the substrate through said ink jet printing station.

7. The method according to claim 1, wherein said first ink layer is applied in one pass of the substrate through an ink jet printing station, and said intermediate layer and said second ink layer are applied serially in a second pass of the substrate through a coating station and an ink jet printing station.

8. The method according to claim 1, wherein said intermediate layer is of a white semi-opaque material, and said first and second ink layers are the same printed pictures.

9. The method according to claim 1, wherein said intermediate layer is of an opaque material, and said first and second ink layers are different printed pictures.

10. The method according to claim 1, wherein said transparent substate is a rigid panel serving as a supporting base for the sign.

11. A method of printing signs, comprising:

printing a first ink layer directly on one face of a transparent substrate;

applying an intermediate layer over said first ink layer; and printing a second ink layer directly on said intermediate layer, wherein said first and second ink layers and said intermediate layer are all applied by liquid jet printers.

12. The method according to claim 11, wherein each of said first and second layers is of liquid ink printed by an ink jet printer and is dried before the next layer is applied.

13. The method according to claim 12, wherein said intermediate layer is air sprayed as a coating onto said first ink layer.

14. The method according to claim 11, wherein the face of said transparent substrate opposite to said one face in pre-coated with an adhesvie material covered by a removable protective layer which, after the printing of said first and second ink layers with the intermediate layer in between, is removed from the substrate to expose the adhesive material for attaching said sign to a mounting member.

15. The method according to claim 11, wherein said transparent substrate is of a flexible plastic sheet material.

16. The method according to claim 11, wherein said first ink layer and said intermediate layer are applied serially in one pass of the substrate through an ink jet printing station and a coating station, and said second ink layer is applied to said intermediate layer in a second pass of the substrate through said ink jet printing station.

17. The method according to claim 11, wherein said first ink layer is applied in one pass of the substrate through an ink jet printing station; and said intermediate layer and said second ink layer are applied serially in a second pass of the substrate through a coating station and an ink jet printing station.

18. Apparatus for printing signs, comprising:

an ink printing station including a plurality of nozzles for printing an ink layer directly on one face of a substrate;

a coating station for applying a coating onto the ink layer;

a substrate drive for driving the substrate first through said ink printing station and then through said coating station; and a second ink printing station downstream of said coating station, said second ink printing station also including a plurality of nozzles for printing a second ink layer on said coating.

19. The apparatus according to claim 18, wherein said coating station includes a sprayer for spray-coating a material onto said ink layer.

20. The apparatus according to claim 18, wherein said substrate drive drives a substrate which is pre-coated with an adhesive material on the face thereof opposite to that to receive the ink layer and the coating, which adhesive material is covered by a removable protective layer.

21. A printed sign, comprising:

a transparent substrate;

an adhesive coating on a first face of the transparent substrate;

a removable protective layer covering said adhesive coating;

a first printed ink layer on the opposite face of said transparent substrate;

an intermediate coating on said first printed ink layer; and a second printed ink layer on said coating;

wherein said first ink layer, said intermediate coating and said second ink layer are applied serially in a single pass of the substrate through a first ink jet printing station, a coating station for the intermediate layer, and a second ink jet printing station.

22. The sign according to claim 21, wherein said substrate is of a flexible plastic sheet material.

23. The sign according to claim 21, wherein said sign, after said protective layer is removed, is moutned on its adhesive-coating face to a transparent mounting panel within a housing having an artificial light source facing said mounting panel.

24. The sign according to claim 21, wherein said coating material is a white semi-opaque material, and said first and second printed ink layers are the same printed pictures.

25. The sign according to claim 21, wherein said coating material is an opaque material, and said first and second printed ink layers are of different printed pictures.

26. The sign according to claim 21, wherein said transparent substrate is a rigid panel serving as a supporting base for the sign.

27. A printed sign, comprising:

a transparent substrate;

a first printed ink layer of a first picture on one face of said transparent substrate;

a coating of an opaque material over said first printed ink layer;

a second printed ink layer of a second picture, different form said first picture, on said coating of said opaque material;

wherein said first ink layer, said coating and said second ink layer are applied serially in a single pass of the substrate through a first ink jet printing station, a coating station for the intermediate layer, and a second ink jet printing station.

* * * * *